US006845801B2

(12) United States Patent
Hsu

(10) Patent No.: US 6,845,801 B2
(45) Date of Patent: Jan. 25, 2005

(54) CORD COLLECTOR FOR A BLIND

(75) Inventor: Pey-Son Hsu, Changhua Hsien (TW)

(73) Assignee: Ching Feng Blinds Ind. Co., Ltd., Changhua Hsien (TW)

( * ) Notice: Subject to any disclaimer, the term of this patent is extended or adjusted under 35 U.S.C. 154(b) by 0 days.

(21) Appl. No.: 10/449,123

(22) Filed: Jun. 2, 2003

(65) Prior Publication Data

US 2004/0238132 A1 Dec. 2, 2004

(51) Int. Cl.[7] ..... E06B 3/48
(52) U.S. Cl. ..... 160/84.04; 160/173 R
(58) Field of Search ..... 24/130; 160/168.1 R, 160/173 R, 178.1 R

(56) References Cited

U.S. PATENT DOCUMENTS 2,592,995 A * 4/1952 Anderle ..... 160/173 R
2,594,806 A * 4/1952 Rosenbaum ..... 160/173 R
2,600,062 A * 6/1952 Lorentzen ..... 160/178.1 R
4,621,673 A * 11/1986 Georgopoulos et al. ..... 160/168.1 R
5,918,656 A * 7/1999 Daniels et al. ..... 160/168.1 R

* cited by examiner

*Primary Examiner*—Blair M. Johnson
(74) *Attorney, Agent, or Firm*—Troxell Law Office PLLC

(57) ABSTRACT

A cord collector for a blind having upper and lower beams with a blind body attached and a cord collector disposed beneath the lower beam wherein the blind body has a plurality of central cord-passage holes equidistantly spaced for a cord to be led through. The cord is fixed to the upper beam at a first end, led through the cord-passage holes, the lower beam and the cord collector, and connected at a second end to a retaining cap. In use, the blind is adjusted to a desired height, the cord is drawn downwards to reveal an extending section that is wound around left and right guide arcs of the cord collector, and then turned in crisscross to be adapted at a rear retaining slot and front L-shaped holding slots respectively via an arc guide plate so as to completely retrieve the extending section on to the cord collector.

4 Claims, 5 Drawing Sheets

CORD COLLECTOR FOR A BLIND

BACKGROUND OF THE INVENTION

1. Field of the Invention

The present invention relates to a cord collector for a blind, comprising an upper and a lower beam with a blind body attached there-between, and a cord collector disposed beneath the lower beam thereof wherein the blind body has a plurality of central cord-passage holes equidistantly disposed at the middle thereof for a cord to be led there-through. The cord, securely fixed to the upper beam at one end and led through the cord-passage holes at the other end, is passed through the lower beam and located on the cord collector thereon via a retaining cup disposed at the bottom end thereof. When a height of the lower beam of the blind is adjusted, an extending section of the cord is wound around and gathered in crisscross on the cord collector thereon so as to completely and securely retrieve the pulling cord thereof, safely preventing children from getting suffocated or hurt when playing around the Venetian blind thereof.

2. Description of the Prior Art

Please refer to FIG. 1. A conventional blind 10 is mainly made up of an upper and a lower beams 11, 12 with a blind body 13 attached there-between. The blind body 13 has a plurality of equidistant cord-passage holes 131 disposed at both sides thereof for a left and a right pull cords 14, 14' to be led there-through respectively. The left and the right pull cords 14, 14', securely fastened to the lower beams 11, 12 at one end thereof and respectively led upwards through the cord-passage holes 131 thereof, are passed through a locating means 111 disposed at one side of the upper beam 11 and extended downwards at the other end to form a left and a right pulling sections 141, 141' respectively. The blind 10 thereof can be gathered up or unfolded via the left and the right pulling sections 141, 141' of the left and the right pull cords 14, 14'.

There are some drawbacks to such conventional blind structure. Most of all, when the blind body 13 of the blind 10 is gathered upwards in withdrawal, the left and the right pulling sections 141, 141' of the left and the right pull cords 14, 14' are suspended downwards for a certain length, which may unsafely cause danger to children playing around. In case of an accident when a child got wound up by the suspending left and right pulling sections 141, 141' thereof by the neck, the struggling force of a child to get out there-from can easily detach the left and right pull cords 14, 14' from the locating means 111 thereof, activating the withdrawal of the left and right pulling sections 141, 141' thereof to unfold the blind body 13 thereof. Thus, a child might get suffocated or hurt by the withdrawing left and right pulling sections 141, 141' thereof.

SUMMARY OF THE INVENTION

It is, therefore, the primary purpose of the present invention to provide a cord collector for a blind, comprising an upper and a lower beam with a blind body attached there-between, and a cord collector disposed beneath the lower beam thereof wherein a cord, attached to the upper beam at one end, is led through central cord-passage holes of the blind body and the lower beam thereof respectively, and located onto the cord collector at the other end thereof. When a height of the blind is adjusted, an extending section of the pull cord is wound and gathered in crisscross on the cord collector thereon so as to completely retrieve the pulling cord thereof, safely preventing children from getting suffocated or hurt when playing around the blind thereof.

It is, therefore, the secondary purpose of the present invention to provide a cord collector for a blind wherein the extending section of the pull cord is easily and quickly wound and gathered in crisscross on the cord collector thereon for location thereof, securely preventing the pull cord from detaching therefrom.

DETAILED DESCRIPTION OF THE PREFERRED EMBODIMENTS

Figure 1:
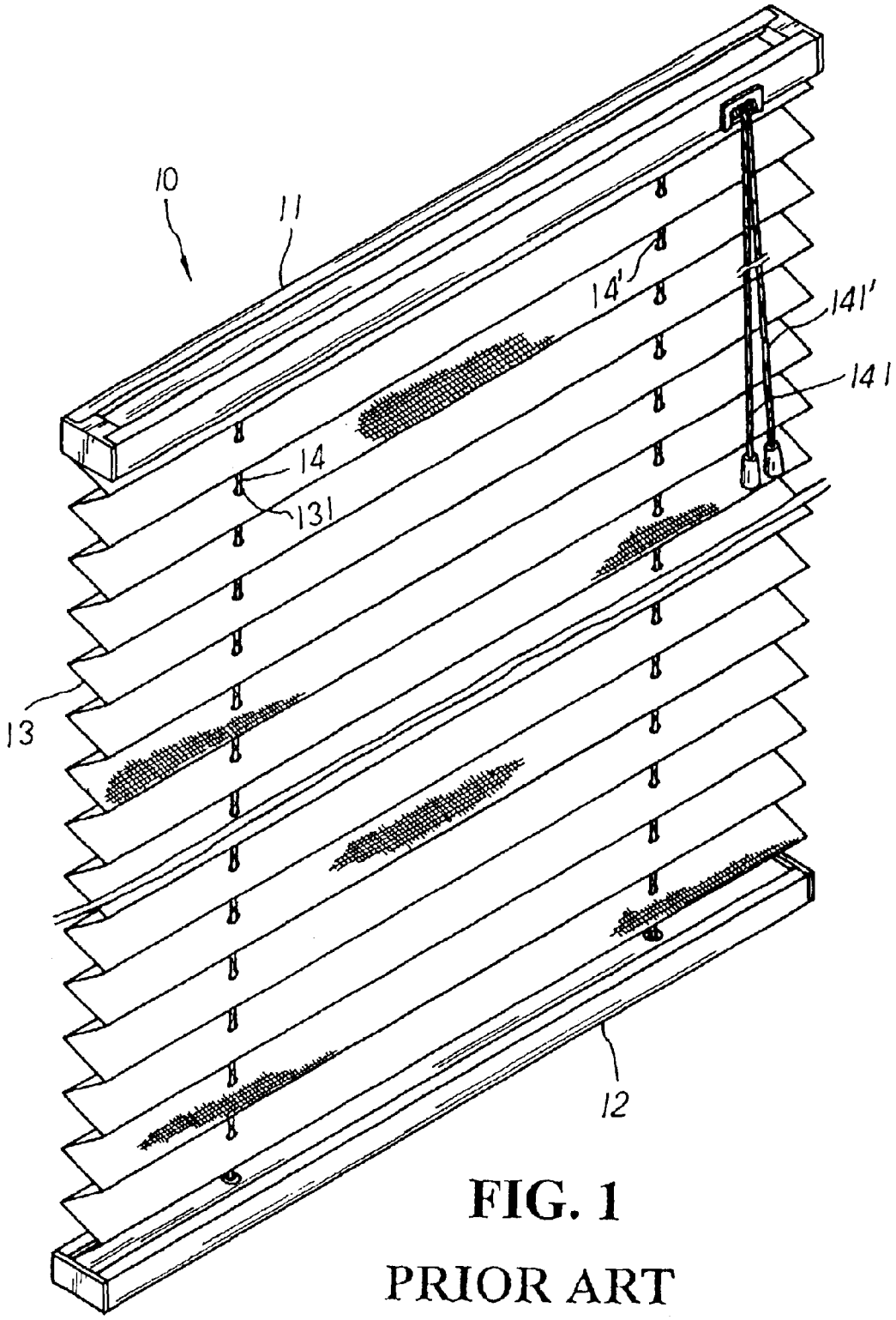
FIG. 1 PRIOR ART
FIG. 1 is a perspective view of a conventional Venetian blind.
Figure 2:
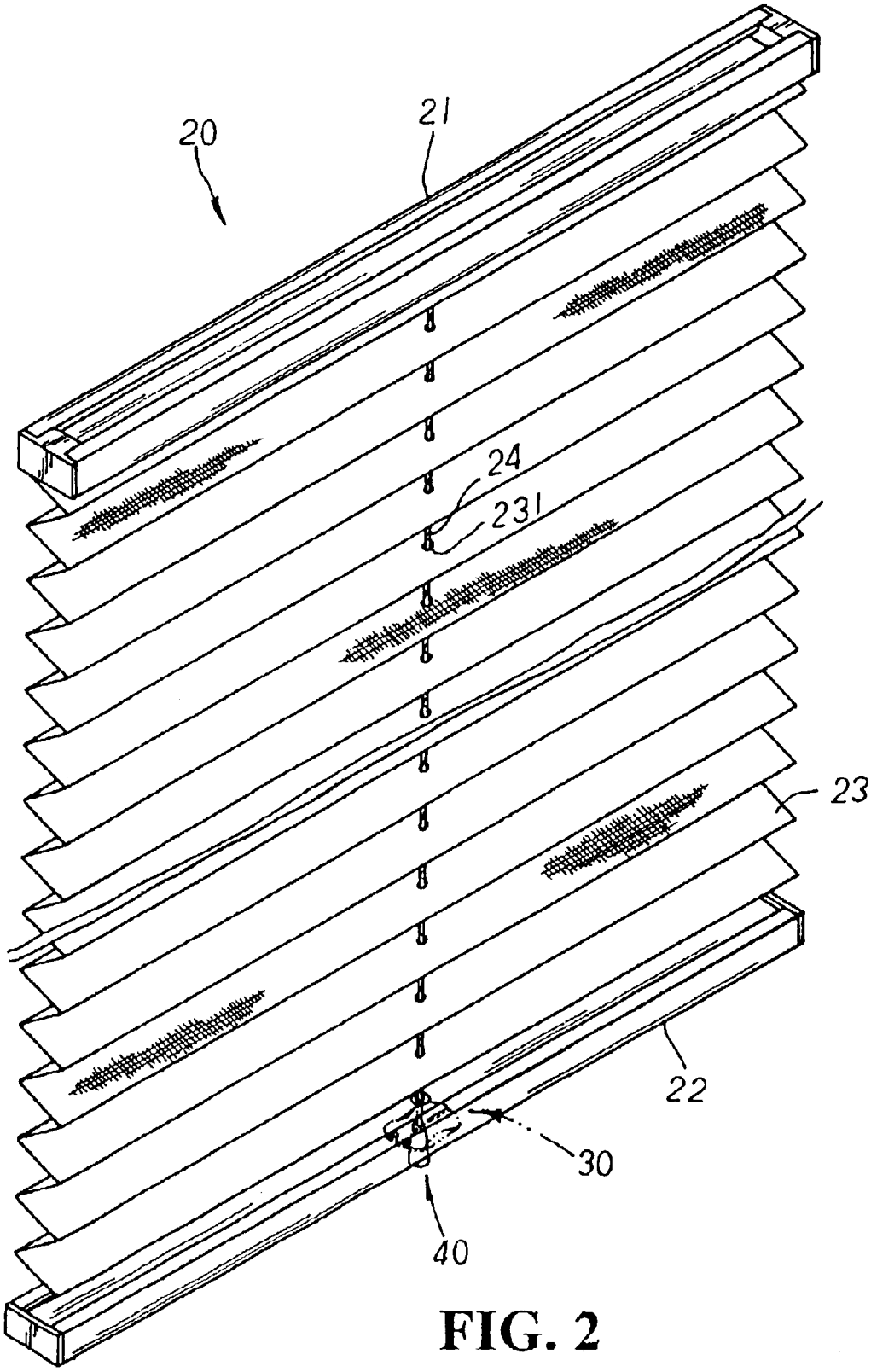
FIG. 2 is a perspective view of the present invention.
Figure 3:
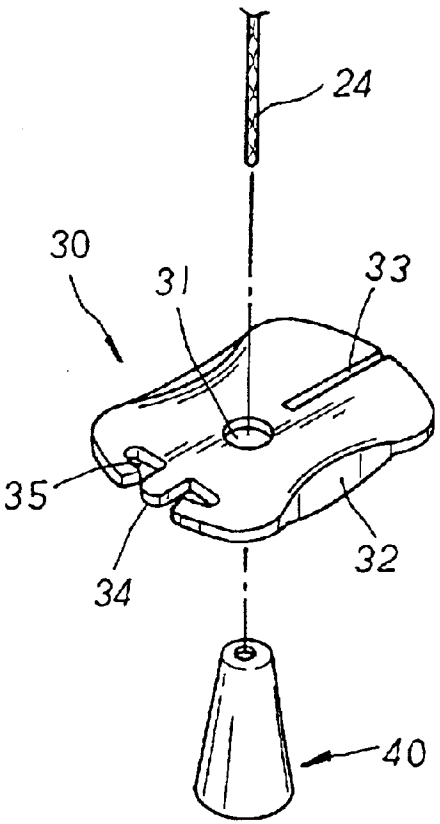
FIG. 3 is a partially exploded view of the present invention.

Please refer to FIGS. 2, 3. The present invention is related to a cord collector for a blind 20, comprising upper and lower beams 21, 22 with a blind body 23 attached there-between, and a cord collector 30 disposed beneath the lower beam 22 thereof. The blind body 23 has a plurality of central cord-passage holes 231 equidistantly disposed at the middle thereof for a cord 24 to be led therethrough. The cord 24, securely fixed to the upper beam 21 at a first end and a second end is inserted through the central cord-passage holes 231 and passed through the lower beam 22 and through a hole 31 of the cord collector 30 with a retaining cap 40 attached at the second end thereof for abutting location thereof. The cord collector 30, integrally molded, also includes a pair of opposite guide arcs 32 disposed at both sides thereof, a retaining slot 33 cut at the rear thereof, an arc guide plate 34 projecting at the front thereof, and a pair of L-shaped holding slots 35 defining both sides of the arc guide plate 34 thereof as shown in FIG. 3.

Figure 5:
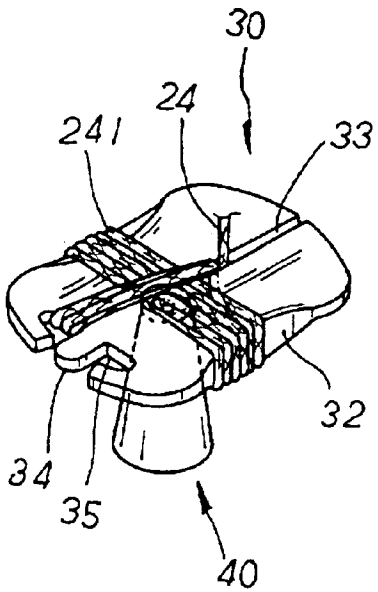
FIG. 5 is a diagram showing the winding up of a pull cord onto the pull cord collector of the present invention.
Figure 4:
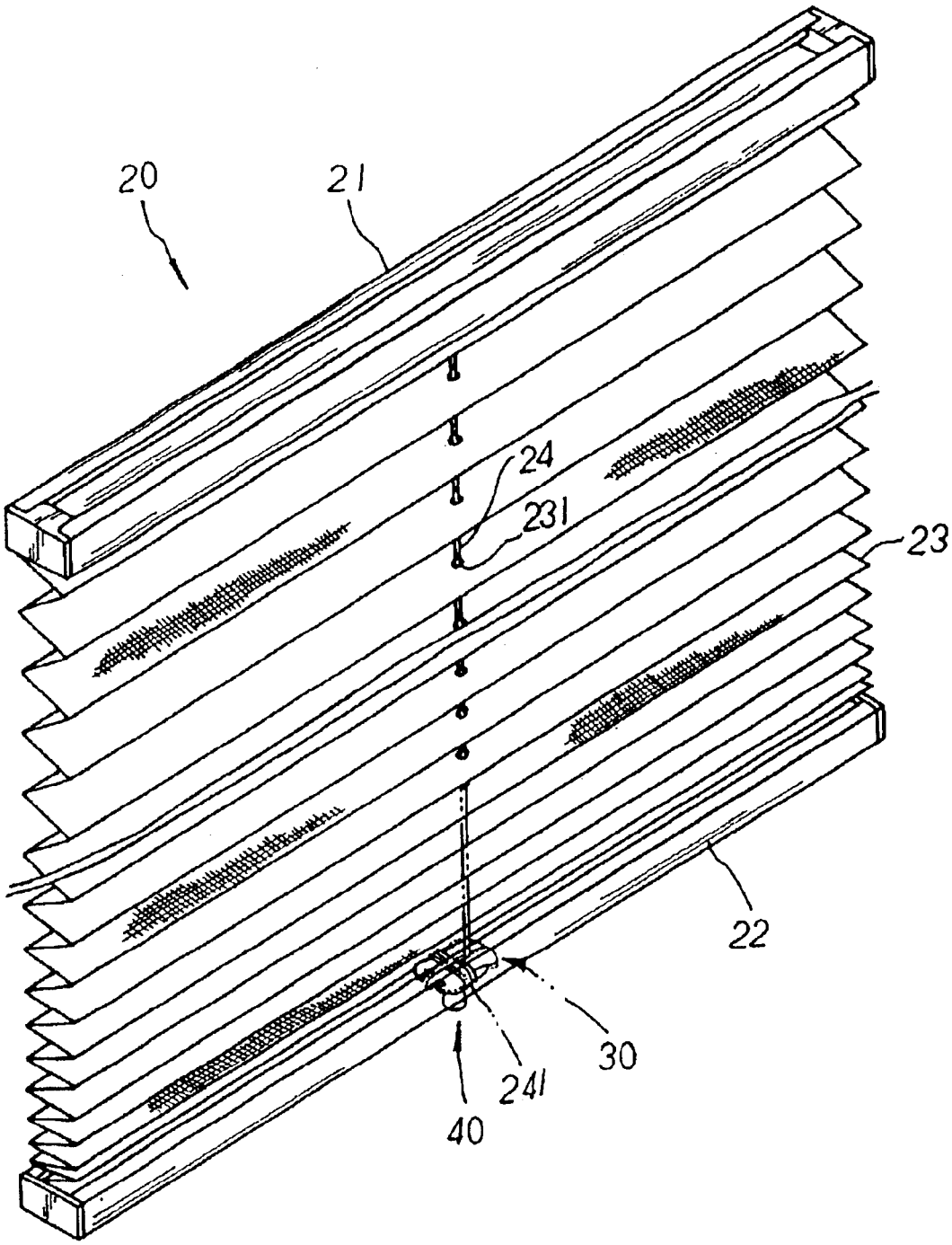
FIG. 4 is a perspective view of the present invention in practical use.

Please refer to FIGS. 4, 5. In use, the lower beam 22 is adjusted to a predetermined height, the cord 24 is drawn downwards to reveal an extending section 241 located below the lower beam 22 thereof. The extending section 241 thereof is then wound on the cord collector 30 thereon in retrieval thereof. The extending section 241 is first wound around the opposite guide arcs 32 of the cords collector 30 thereof, and then turned in crisscross to be adapted at the retaining slot 33 and slid into the L-shaped holding slots 35 respectively via the arc guide plate 34 thereof as shown in FIG. 5. The cord 24 with the extending section 241 completely retrieved on the cord collector 30 thereon is securely located via the retaining cap 40 abutting closely against the bottom side of the through hole 31 thereof, safely preventing children from getting suffocated or hurt when playing around the blind.

Figure 6:
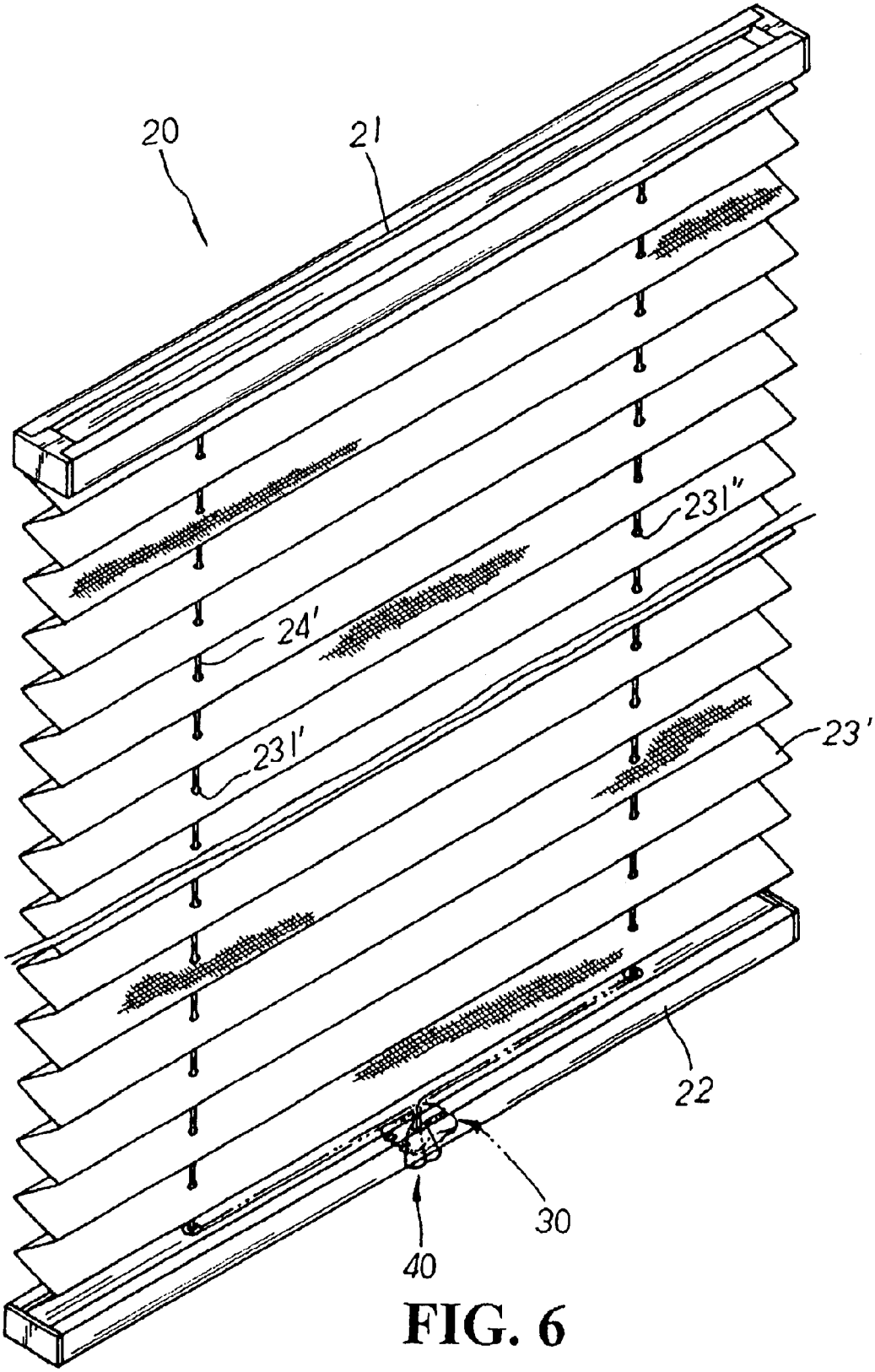
FIG. 6 is a perspective view of another embodiment of the present invention.

Please refer to FIG. 6. The blind 20 can also have a blind body 23' with left and right cord-passage holes 231', 231" symmetrically disposed at both sides thereon. A cord 24', led through the upper beam 21 and turned downwards through the left and right cord-passage holes 231', 231" respectively at both ends thereof, is pivotally passed through both sides of the lower beam 22 and gathered at the through hole 31 of the cord collector 30 to be located thereon via retaining caps 40 abutting closely against the bottom side of the through hole 31 thereof.

What is claimed is:

1. A cord collector, a blind and a cord having an extended section below the blind, the cord collector comprising:

a) a cord collector body having a hole located through top and bottom surfaces thereof;

b) a pair of guide arcs located on opposing sides of the cord collector body;

c) a retaining slot located on a first end of the cord collector body;

d) a pair of L-shaped holding slots located on a second end of the cord collector body; and e) an arc guide plate located between the pair of L-shaped holding slots; such that a first end of the cord adjacent to the extended section is inserted through the hole, the extended section is wound around the pair of guide arcs, and an end of the extended section opposite the first end of the cord is inserted into the retaining slot and at least one of the pair of L-shaped holding slots to secure the extended section of the cord on the cord collector.

2. The combination according to claim 1, further comprising a retaining cap connected to the first end of the cord.

3. The combination according to claim 1, wherein the extended section of the cord protrudes through a lower beam of the blind and the cord collector is located below the lower beam.

4. The combination according to claim 3, wherein a height of the blind is selectively adjusted by winding and unwinding a predetermined amount of the extended section of the cord onto and off of the cord collector, the height being determined when the lower beam presses against the cord collector.

* * * * *